United States Patent [19]

Lamy et al.

[11] Patent Number: 4,468,152

[45] Date of Patent: Aug. 28, 1984

[54] ICEBREAKER SYSTEM FOR MARINE PLATFORMS

[75] Inventors: Jacques E. Lamy, Fontenay-Aux-Roses; Francisco de Asis M. Serrano, Issy-Les-Moulineaux, both of France

[73] Assignee: Compagnie Generale pour les Developpements Operationnels des Richesses sous-Marines "C.G. Doris", Paris, France

[21] Appl. No.: 321,050

[22] Filed: Nov. 13, 1981

[30] Foreign Application Priority Data

Nov. 14, 1980 [FR] France ..... 80 24237

[51] Int. Cl.[3] ..... E02B 15/02; B63B 35/12

[52] U.S. Cl. ..... 405/61; 405/211; 405/217

[58] Field of Search ..... 405/211, 217, 61; 14/76; 114/42

[56] References Cited

U.S. PATENT DOCUMENTS

| | | | |
|---|---|---|---|
| Re. 28,332 | 2/1975 | Schirtzinger | 405/211 |
| 3,693,360 | 9/1972 | Holder | 405/211 |
| 3,696,624 | 10/1972 | Bennett | 114/42 |
| 3,894,504 | 7/1975 | Smith | 405/211 |
| 4,300,855 | 11/1981 | Watson | 405/211 |

FOREIGN PATENT DOCUMENTS

| | | | |
|---|---|---|---|
| 2537918 | 3/1977 | Fed. Rep. of Germany | 405/217 |

*Primary Examiner*—Dennis L. Taylor

*Attorney, Agent, or Firm*—Wigman & Cohen

[57] ABSTRACT

The invention relates to an icebreaker system for marine platforms wherein the system includes two rings of obstacles: a lower ring and an upper ring fixed around pillars of the platform to be protected. The lower ring has obstacles showing a portion sloping upwardly and rearwardly. The upper ring has obstacles staggered with those of the lower ring and showing a portion sloping downwardly and rearwardly. A ring of obstacles is mounted rotatably and/or movably in the vertical direction. The obstacles are of truncated pyramid shape and asymmetrically shaped in front elevation.

17 Claims, 12 Drawing Figures

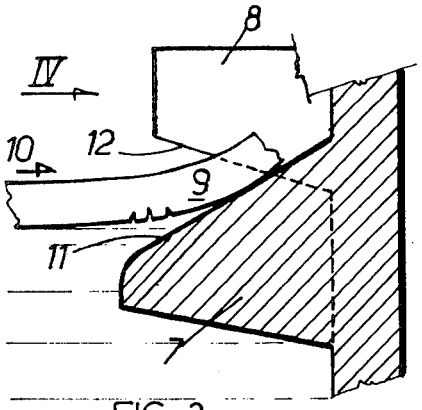
FIG.:3
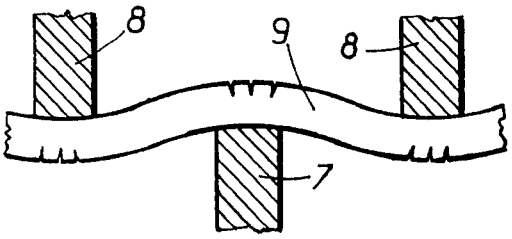
FIG.:4
FIG.:5
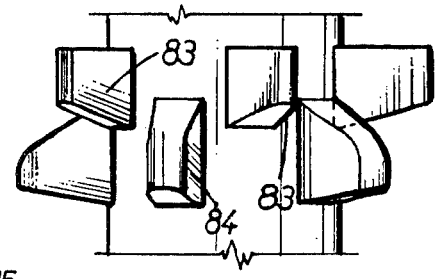
FIG.:6
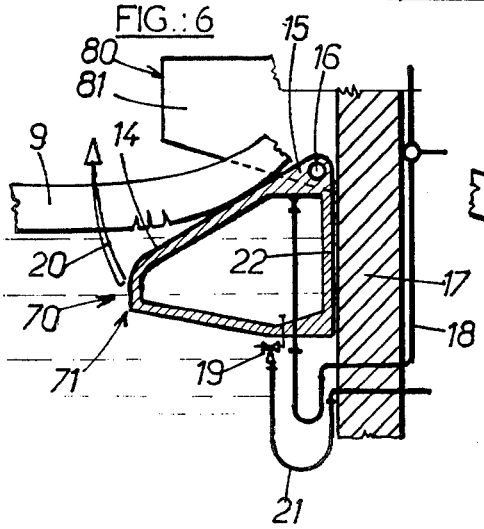
FIG.:7
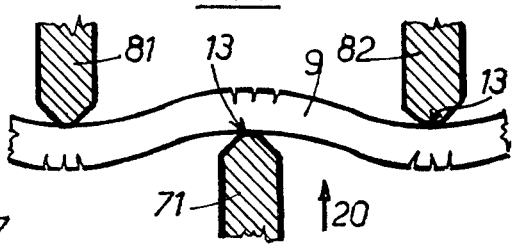
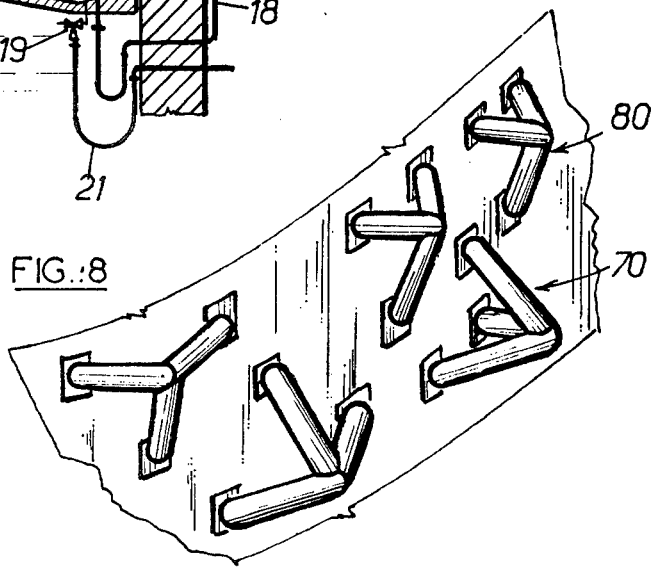
FIG.:8

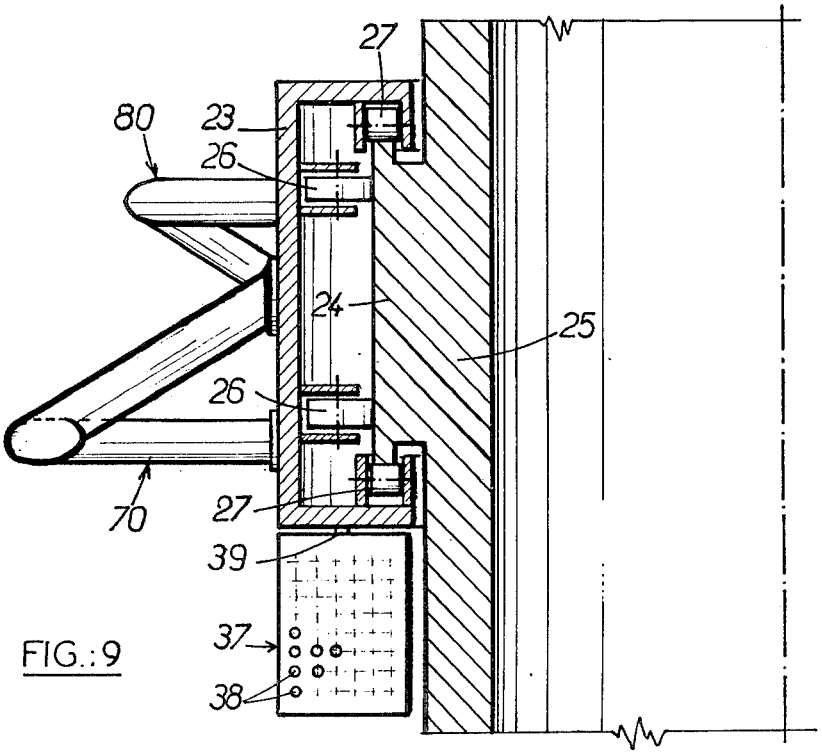
FIG.:9
FIG.:10
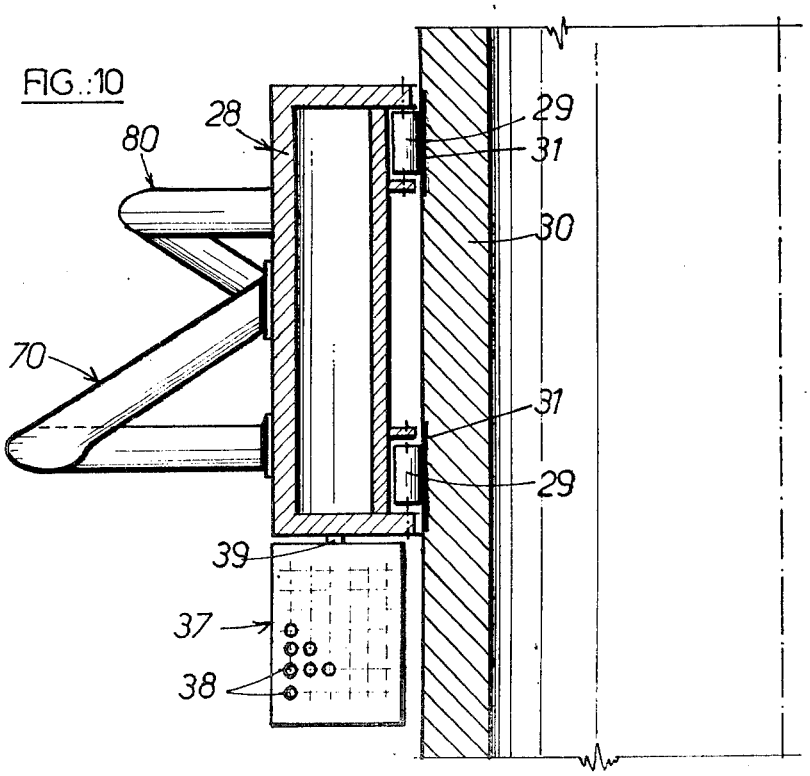

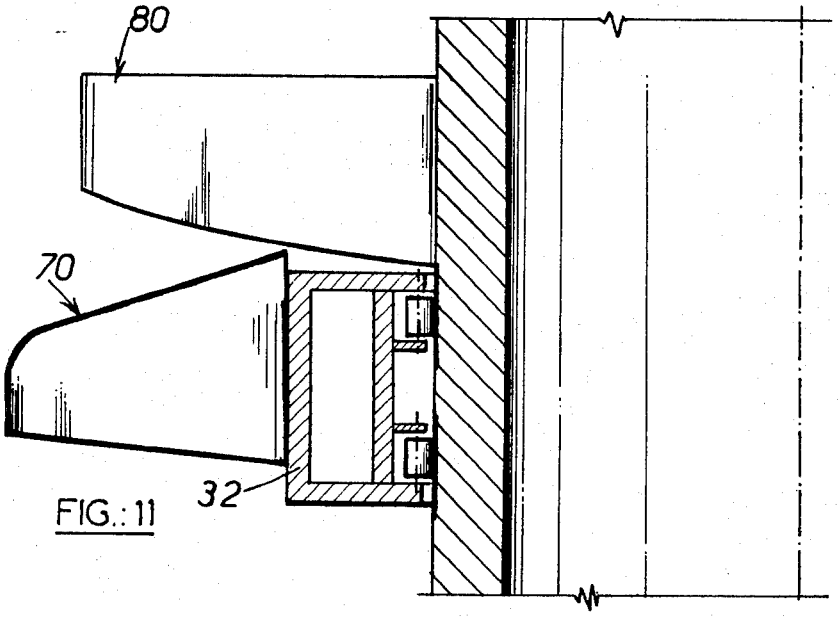
FIG.: 11
FIG.: 12
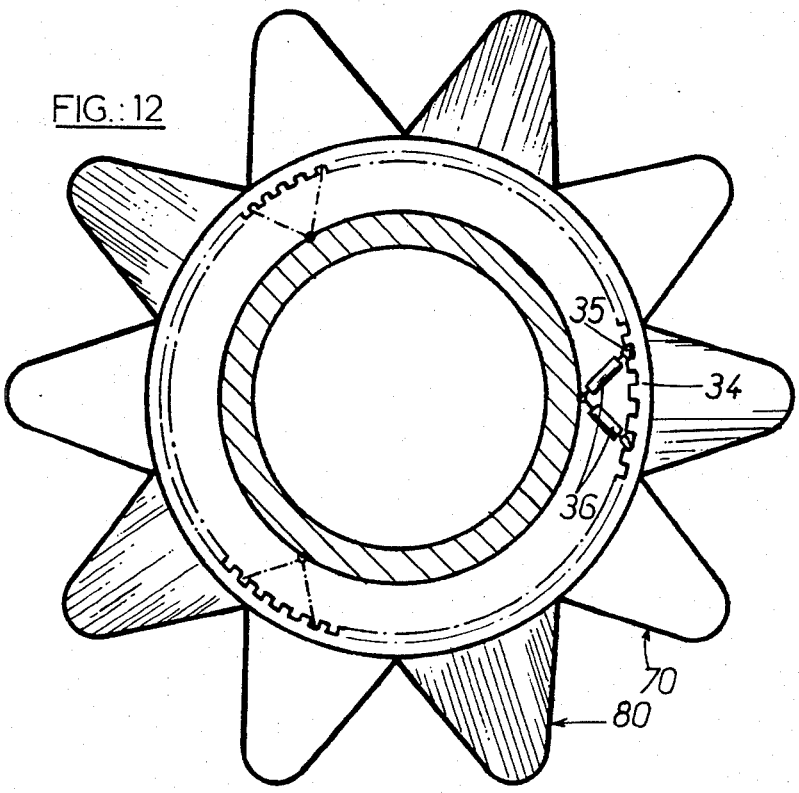

ICEBREAKER SYSTEM FOR MARINE PLATFORMS

BACKGROUND OF THE INVENTION

1. Field of the Invention

This invention relates to an icebreaker system for marine platforms and to a platform equipped therewith, said plaform being of the weighted-base type or of the 'jacket' type with multiple columns fixed to the ground by driven-in piers.

2. Description of the Prior Art

Oil exploration and extraction operations in waters lying near to or above the 70th parallel North pose very tricky problems in winter. For whereas the sea becomes clear or nearly so in summer, with numerous errant ice-floe residues, winter brings with it a line of ice which advances in relatively invariable directions. Thus, at the latitude of the Beaufort Sea, the ice is virtually unbroken 'pack ice' advancing into the sea. The thickness of this sheet of ice is from about 3 meters to 9 meters, but in some places cliffs up to 30 meters high are formed when two sheets of ice thrust against each other. Indeed the movements of these nondefined ice floes implies relative motions which develop immense pressures and create upraised areas formed by the shattering and superimposition of excess material.

The whole ice system transits constantly with respect to a fixed point, though with occasional halts and resumptions of the movement and with changes of direction.

The methods at present used for setting up oil operations in a fixed area are of two kinds:

the first consists in creating a zone which is protected by a fairly high embankment having a slope such that the pack ice is raised as it moves over the slope and breaks up into pieces which transit more or less past the obstacle placed before them;

the second resorts to weighted-base conical platforms which, by a mechanism similar to that described precedingly, breaks up the sheet of ice as it rises over the slope opposing it.

The difficulty with both these methods stems primarily from the short time for which there is free access to the job sites. It is necessary for the work—dredging and the like—to be carried out during the period when the ice opens up, or else icebreakers have to be kept moving around the job site continually in order to prevent the latter from being disrupted by the arrival and movement of the ice floes. Despite the shallowness of the water in the regions of interest (10 to 50 meters), the solutions mentioned above call for fairly extensive and hence very costly excavation work.

SUMMARY OF THE INVENTION

The present invention has for its object a system capable of being mounted on a platform, thereby achieving fragmentation of the sheet of ice without the need for recourse to enormous and costly structures.

The system is devised in the form of alternating obstacles, some of which tend to raise the ice floes whereas the immediately adjacent obstacles tend to cause it to dip below the surface of the water. This arrangement achieves a shearing process which is more localized and more intense than that caused when the ice rises over a cone or slope; moreover the vertical reaction created on the lower obstacles is wholly or partly canceled by the reaction produced on the upper obstacles.

The obstacles are so arranged as to cause the evacuation and transiting of the pieces of ice to take place continuously.

BRIEF DESCRIPTION OF THE DRAWINGS

The description which follows with reference to the accompanying exemplary drawings will give a clear understanding of how the invention can be carried into practice.

In the drawings:

FIGS. 3 and 4 are respectively sectional side and partial sectional front elevation views of the fragmentation of an ice floe over fixed obstacles.

FIG. 5 shows an embodiment of obstacles permitting evacuation of the broken ice.

FIGS. 6 and 7 are respectively sectional side and part-sectional front elevation views of the shattering of an ice floe between two fixed upper obstacles and one mobile lower obstacle FIG. 8 is a fragmental perspective view of an alternative form of embodiment of the obstacles.

FIG. 9 shows in partial section a platform-supporting pillar bearing an icebreaker system having its two rings of obstacles fixed to a rotating concentric cage.

FIG. 10 shows in partial section a platform pillar bearing an icebreaker system having its two rings of obstacles fixed to a concentric annular float.

FIG. 11 shows in partial section a platform pillar bearing an icebreaker system having one of the rings of obstacles fixed and the other supported by a concentric annular float.

FIG. 12 is a diagrammatic portrayal of the rotating motion imparted by cog-engaging jacks.

DETAILED DESCRIPTION OF THE PREFERRED EMBODIMENT

Figure 1:
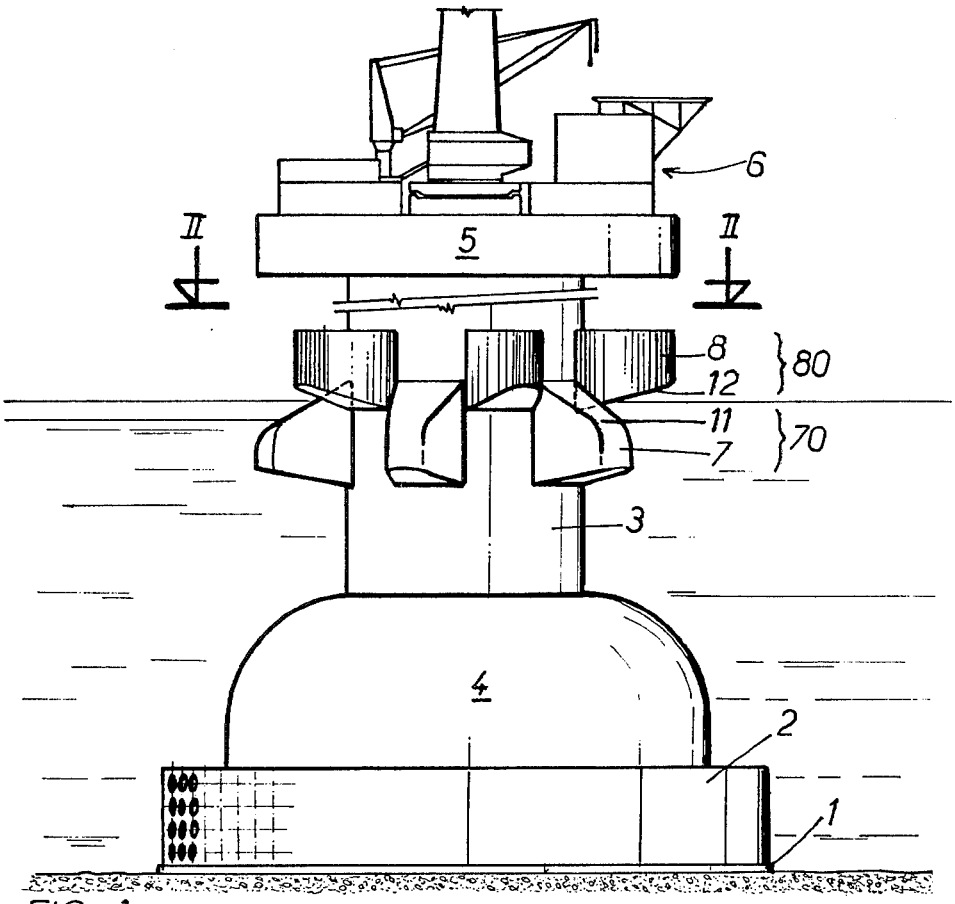
FIG. 1 schematically illustrates a platform equipped with one form of embodiment of the subjector icebreaker system of this invention.
Figure 2:
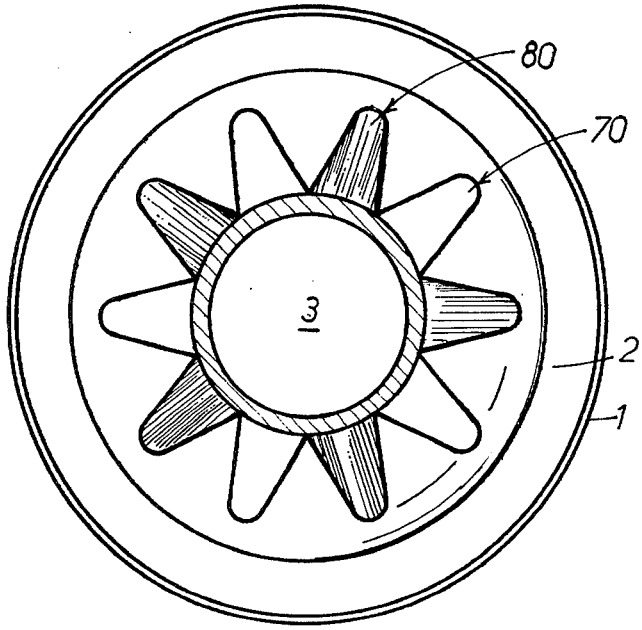
FIG. 2 is a section through the the line II—II of FIG. 1.

FIG. 1 depicts a marine platform of the weighted-base and single central pillar type. The foundation 1 resting on the seabed bears along its periphery a perforated anti-underwash wall 2 and in its middle the supporting pillar 3 the lower part of which is surrounded by storage tanks 4. The deck 5 is fixedly centered upon pillar 3 and carries the oil exploration and/or extraction equipment 6. Obstacles 7, 8 are arranged in two rings on said pillar, to wit an at least partly submerged lower ring 70 and an upper emerging ring 80. These obstacles 7 and 8 are arranged in alternation, the obstacles of one ring 70 lying between those of the other ring 80. In one form of embodiment shown in FIG. 1, the obstacles 7 and 8 are substantially truncated-pyramid shaped. The obstacles 7 of lower ring 70 have a flat face 11 sloping upwardly from front to rear whereas the obstacles 8 of upper ring 80 have a flat face 12 sloping downwardly from front to rear (FIG. 3). The angle between the two faces 11 and 12 is of the order of 50° to 60°. The positions of the rings 70 and 80 on the pillar 3 are fixed and are based on the lower and upper levels of the ice and on the height of the tides, in such manner that the ice floe be sheared by a group of at least three obstacles 7 and 8. FIG. 4 shows, taken on the line IV of FIG. 3, the manner of action of the obstacles 7 and 8: the ice floe 9 is first raised by lower obstacle 7 and broken in a direction at right angles to its motion (arrow 10) whereas the upper ring of obstacles 8 acts jointly with the lower ring of obstacles 7 to shatter the ice in the direction of its motion 10. The blocks of ice are evacuated by means formed, for example, by helical grooves (not shown) provided on the surface of the pillar 3 or by the asymmetric shapes 83 and 84 of the obstacles (FIG. 5) whose faces in contact with the ice are rounded, the blocks being set in motion by the pressure forces exerted by the pack ice.

In the form of embodiment shown in FIG. 3, the obstacles 7 and 8 are formed by prefabricated concrete blocks fixed to the supporting pillar 3 by means well-known per se involving prestressed-fastening techniques. In alternative embodiments of this invention, the obstacles 7 and 8 could be formed by prestressed concrete shells with reinforcing partition walls or by steel shells reinforced by flanges in accordance with techniques well-known in the construction of icebreaker hulls.

In order to concentrate the shearing forces, the obstacles have, in lieu of the flat surfaces 11, 12 or approximately flat surfaces as shown in FIG. 4, the shape (71, 81, 82) of a prism (FIG. 7) the edges 13 of which contact the ice floe 9 to be broken up in the direction of arrow 20.

In the embodiment illustrated in section in FIG. 6, the lower ring 70 of obstacles are formed by watertight caissons 71 movable in the direction of arrow 20 in radial planes of the structure to be protected against the ice floe 9. The cross-section of an obstacle taken through a radial plane is substantially right-angle-shaped, with the triangle restrained by hinge means formed by a pin 16 on the upper edge 15 adjacent the wall 17 and hingedly supported in clevises (not shown) fixed to the wall 17 of the pillar 3, the side 22 being normally parallel to the wall 17 or resting against it. In this embodiment, the obstacle is metallic and is constructed using icebreaker ship hull technology, its sloping face 14 being prism-shaped with a middle edge line 13 (FIG. 7).

Buoyancy control means, illustrated schematically, allow the obstacles to be ballasted with sea water and include a bleed and discharge pipe 18 and a ballasting valve 19 remote-controlled through pipe 21. Manifestly, the ballasting means and most notably the pipes 18 and 21 could be arranged differently, being for example connected close to or along the retaining pin 16.

The movable obstacles act in the following manner: in the position shown in FIG. 6, each obstacle in lower ring 70 is filled with water in such manner that its side 22 rests against the pillar wall 17 and its sloping face portion 14 faces the ice floe 9; when the ice floe 9 has slid over the sloping face 14 and comes into contact with the downwardly sloping surface or edge line of obstacles in the upper ring 80 thereof, water is driven out of the interior of each obstacle in lower ring 70 and the hydrostatic thrust rotates each obstacle upwardly in the direction of arrow 20 while at the same time applying, against ice floe 9 jammed between upper obstacles with prism shapes 81, 82 (FIG. 7), a shearing force great enough to fracture it. The magnitude of this force can readily be controlled by the volume of the obstacle, the latter being sized according to ice conditions in the region being exploited.

In an alternative form of embodiment, the obstacles take the form of trihedrons (FIG. 8) constructed of steel tubing and arranged in two rings 70 and 80 and in which one corner line of each trihedron lies in a radial plane and extends toward the center of each ring each 70 and 80. The trihedrons are arranged similarly to the obstacles 7 and 8 in the other forms of embodiment, with one edge of a trihedron performing the same function as the edges 13 of obstacles with prism shapes 71 and 81 of the embodiment shown in FIG. 7.

Evacuation of the blocks of broken ice is accomplished passively by the thrust forces exerted by the pack ice. As described precedingly, the blocks are diverted by grooves formed on the pillar 3 or by the asymmetric shapes 83 and 84 of the obstacles 7 and 8 shown in FIGS. 3–5 the lateral faces on any given side extending rearwardly at an angle to the radial plane. In some cases however, particularly when the ice is thick, this method can have drawbacks due to the slowness of the evacuation process. In order to achieve rapid, controlled evacuation, therefore, the rings 70 and 80 of obstacles shown in FIGS. 9–12 are caused to revolve around the structure to be protected, thus throwing the blocks of ice, relatively quickly, downstream of the structure with respect to the direction of travel of the pack ice.

In a first form of a revolving embodiment (FIG. 9), the two rings of 70 and 80 of obstacles are mounted on a cage 23 which revolves on a hoop 24 fixed around the structure to be protected and more particularly to the pillar wall 25. Cage 23 is mounted on rollers 26 which run over the lateral surface of hoop 24 and transmit to the pillar 3 the pressure forces generated by the thrust of the pack ice. Further rollers 27 cooperating with the edges of hoop 24 prevent longitudinal motion of the cage 23 and bear the weight of the ice floe 9 engaged over the sloping surfaces or edges of the obstacles of lower ring 70.

In a second embodiment (FIG. 10), the two rings 70 and 80 of obstacles are fixed to an annular float 28 coaxial with the pillar 3 of the structure to be protected and equipped with rollers 29 which run on the surface of pillar wall 30. Preferably, roller races 31 are provided on the surface of the pillar wall 30 and over the probable vertical distance of travel of float 28.

The above-described system can be used in two different ways to be described hereinbelow.

The first method consists in so adjusting the buoyancy of the float 28 supporting the two rings 70 and 80 as to cause the ends of the lower obstacles to lie a little below the level of the ice and the ends of the upper obstacles a little above it, whereby the ice floe 9 engaging over the lower obstacles causes the float 28 to submerge further. Initially, the icebreaking process is produced solely by the thrust of the ice floe 9 between the staggered obstacles, 7 and 8 as shown in FIGS. 4 and 7. The ice floe 9, which rested on the lower obstacles 7, is thereby lightened, and the ice is broken in an upward direction as the float 28 reverts to its steady-state position. The second method employs a float 28 equipped with buoyancy control means. The ring-supporting float 28 is so ballasted as to cause the lower obstacles 7 to pass beneath the ice floe 9, after which the float 28 is lightened so that it breaks the ice upwardly as it rises; the float 28 is then weighted so that the upper obstacles 8 break the ice in a downward direction. It is thereby possible to clear an area of ice completely all around the structure to be protected.

In one form of embodiment, a fixed upper ring 80 of obstacles is combined with an obstacle-supporting lower ring 70 on a float 32 to provide the arrangement shown in FIG. 11. The upper ring 80 of obstacles is fixed to the wall of the pillar 3 to be protected and the lower ring 70 of obstacles is supported by the partitioned annular concentric float 32. The float has means for modifying its buoyancy. Lightening of the float 32 causes the same to rise and, in so doing, to shatter the ice between the movable obstacles on lower ring 70 and the fixed obstacles on upper ring 80 in a fashion similar to that of the embodiment shown in FIG. 6.

Evacuation of the broken ice is effected, in the systems depicted in FIGS. 9 and 10, by setting in rotation the rings 70 and 80 of obstacles and most notably the cage 23 or the float 28. As diagramatically illustrated in FIG. 12, this rotation is accomplished by means or a ring-gear 34 provided on the movable portion of the obstacle and rotated by drive means formed by pawls 35 actuated by jacks 36 fixed to the wall. The rings 70 and 80 of obstacles are rotated in one direction or the other depending on the asymmetric distribution of broken ice.

A similar system can be used to impart motion to the lower ring 70 mounted on float 32 (FIG. 11) after the lower obstacles have been disengaged from the upper ring 80 of obstacles by ballasting of the float 32.

Rotation can be obtained also, without any special artifice, since the horizontal thrust of the pack ice will never be vigorously centered in relation to the vertical symmetry plane of the rings 70 and 80.

Rotation can be imparted to the systems shown in FIGS. 9, 10 by yet another passive method consisting in providing, on the lower part of the support of cage 23 and float 28, panels 37 having formed therein a plurality of frusto-conical holes 38 which are widened from their smaller base to their larger base in the direction of the current, whereby the latter will generate sufficient force to rotate the rings 70 and 80 in the required direction. Such a system was described for example in French Pat. No. 2 289 761. Changes in the direction of rotation are obtained by turning round the panels 37, which are mounted on orienting devices 39 fast with the bottom of the cage 25 or float 28.

In the case of multicolumn weighted-foundation platforms, each pillar 3 may be equipped with the icebreaker system with fixed or movable rings 70 and 80 and fixed or movable obstacles 7 and 8. Alternatively, there may be provided a hoop surrounding two or more columns of the structure. This hoop (not shown) may or may not bear against the pillars 3 and supports the icebreaker system.

In the case of 'jacket' type platforms in which the pillars 3 are restrained on the seabed by driven piers, the pillars 3 lie within a circular hoop supporting the icebreaker system. This hoop bears against the pillars 3 which are cross-braced in order to withstand and distribute the loads.

These embodiments of the present invention are considered to be illustrative only since other modifications will be readily discerned by those skilled in the pertinent technology. In any event, the scope of the invention is intended to be covered by both the letter and the spirit of the claims appended hereto.

We claim:

1. An icebreaker system for marine platforms or structures erected in seas liable to freeze comprising:

a lower ring and an upper ring of obstacles mounted around pillars of the platform to be protected, the obstacles in the lower ring having a portion sloping upwardly and rearwardly with its front portion lying below the lower level of ice floes at lowest tide, the obstacles in the upper ring thereof being staggered with those of the lower ring and having a portion downwardly and rearwardly with its front portion lying above the upper level of ice floes at highest tide, rearward portions of the obstacles of the upper ring positioned between rearward portions of the obstacles of the lower ring, the portion of the obstacles sloping upwardly and rearwardly in the lower ring tending to raise the ice floes, the portion of the obstacles sloping downwardly and rearwardly in the upper ring tending to lower the ice floes, whereby a shearing process achieves fragmentation of the ice floes.

2. An icebreaker system as claimed in claim 1, in which at least one of the rings is formed by obstacles movable in a vertical plane.

3. An icebreaker system for marine platforms or structures erected in seas liable to freeze, characterized in that it is formed by two rings of obstacles comprising:

a lower ring and an upper ring mounted around the pillars to be protected, the obstacles in the lower ring having a portion sloping upwardly and rearwardly with its front portion lying below the lower level of ice floes at lowest tide, the obstacles in the upper ring thereof being staggered with those of the lower ring and having a portion sloping downwardly and rearwardly, the front part of which lies at the upper level of ice floes at highest tide, in which at least one of the rings is formed by obstacles movable in a vertical plane, and in which the movable obstacles are formed by watertight caissons equipped with hinge means along their upper edge adjacent the structure to be protected whereby rotation of said caissons about said hinge means and by buoyancy control means is permitted.

4. An icebreaker system as claimed in claim 1, in which at least one ring of obstacles is movable in the vertical direction.

5. An icebreaker system as claimed in claim 4, in which the ring of obstacles is mounted on an annular float surrounding the structure to be protected.

6. An icebreaker system as claimed in either of claim 5, in which the annular float is equipped with buoyancy control means.

7. An icebreaker system as claimed in claim 1, in which at least one ring of obstacles is mounted rotatable about the structure to be protected.

8. An icebreaker system as claimed in claim 7, in which at least one ring of obstacles is mounted on a cage freely movable along a hoop fixed to the structure to be protected.

9. An icebreaker system as claimed in claim 7, in which at least one ring of obstacles is mounted on a ring-gear rotated by fixed drive means.

10. An icebreaker system as claimed in claim 1, in which the obstacles are of truncated-pyramid shape.

11. An icebreaker system as claimed in claim 10, in which the obstacles are asymmetrically-shaped in front elevation, the lateral faces on any one side being rearwardly inclined to the radial plane.

12. An icebreaker system as claimed in claim 1, in which the obstacles of at least one ring thereof are formed with an edge line along their inclined face.

13. An icebreaker system as claimed in claim 12 in which the obstacles are formed by trihedrons constructed from tubing and having one edge lying in the radial plane of the structure to be protected.

14. An icebreaker system as claimed in claim 8 in which at least the lower ring of obstacles supports on its lower part panels having frusto-conical holes formed therethrough in the direction of the current whereby rotation is imparted to the ring or rings.

15. An icebreaker system as claimed in claim 14, in which orientation means are provided between said panels and the lower portion of the lower-ring supports.

16. A marine platform having an icebreaker system such as described in claim 1, in which each supporting column thereof is equipped with an icebreaker system.

17. A marine platform having an icebreaker system such as described in claim 16, in which the supporting columns thereof are inscribed within the supporting means for the rings of obstacles.

* * * * *

UNITED STATES PATENT AND TRADEMARK OFFICE

CERTIFICATE OF CORRECTION

PATENT NO. : 4,468,152

DATED : August 28, 1984

INVENTOR(S) : Jacques E. Lamy et al

It is certified that error appears in the above—identified patent and that said Letters Patent is hereby corrected as shown below:

Column 6, line 5, after "portion" insert --sloping--.

Column 6, line 50, delete "either of".

Signed and Sealed this

*Seventh* Day of *May 1985*

[SEAL]

*Attest:*

DONALD J. QUIGG

*Attesting Officer* *Acting Commissioner of Patents and Trademarks*